United States Patent [19]

Nee

[11] Patent Number: 4,693,673

[45] Date of Patent: Sep. 15, 1987

[54] CEILING FAN

[76] Inventor: Victor W. Nee, 1624 Arcadia St., South Bend, Ind. 46635

[21] Appl. No.: 647,393

[22] Filed: Sep. 5, 1984

Related U.S. Application Data

[63] Continuation-in-part of Ser. No. 406,123, Aug. 9, 1982, abandoned.

[51] Int. Cl.[4] ..... F04D 29/38

[52] U.S. Cl. ..... 416/199; 416/175; 416/236 A; 416/5

[58] Field of Search ..... 416/200 R, 201 A, 199, 416/236 A, 237, 175 R, 5, 203

[56] References Cited

U.S. PATENT DOCUMENTS

| | | | |
|---|---|---|---|
| D. 145,227 | 7/1946 | Pryne | 416/223 X |
| 571,500 | 11/1896 | West | 416/236 A X |
| 871,729 | 11/1907 | McChord | 416/223 X |
| 1,699,201 | 1/1929 | Guth | 416/5 X |
| 2,010,094 | 8/1935 | Leinweber | 416/236 A |
| 2,027,050 | 1/1936 | Leinweber | 416/236 A |
| 2,099,196 | 11/1937 | Chapman | 416/199 |
| 2,104,306 | 1/1938 | McLeod | 416/236 A X |
| 2,609,055 | 9/1952 | Monroe | 416/223 |
| 3,630,636 | 12/1971 | Hill | 416/199 |
| 4,222,710 | 9/1980 | Kitagiri et al. | 416/236 A |

FOREIGN PATENT DOCUMENTS

| | | | |
|---|---|---|---|
| 638173 | 11/1936 | Fed. Rep. of Germany | 416/236 A |
| 1035848 | 8/1958 | Fed. Rep. of Germany | 416/5 |
| 1069279 | 7/1954 | France | 416/236 A |
| 7605072 | 11/1977 | Netherlands | 416/5 |

*Primary Examiner*—Everette A. Powell, Jr.
*Attorney, Agent, or Firm*—Eugene C. Knoblock

[57] ABSTRACT

A ceiling fan having a plurality of fan blades which generate axial air flow and which include vane portions positioned angularly to the surface of the blades which direct air flow radially from the blades to increase the range of circulation of the air in a room, to establish a favorable pressure gradient for the axial flow, to increase the efficiency of the ceiling fan and to create a more desirable air flow distribution under the ceiling fan than do conventional ceiling fans.

2 Claims, 12 Drawing Figures

Fig. 1
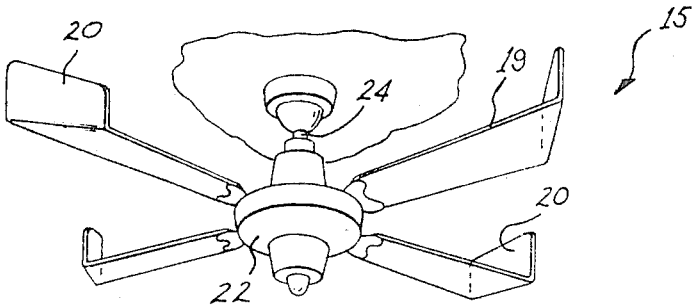
Fig. 2
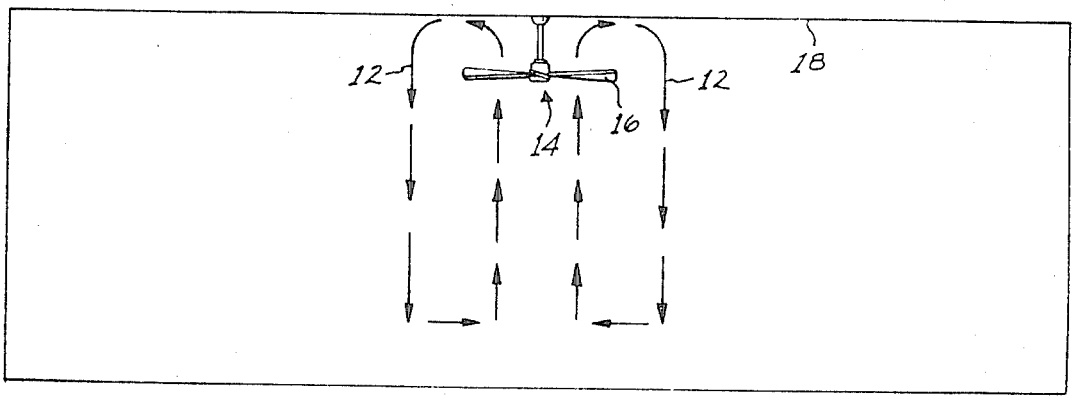
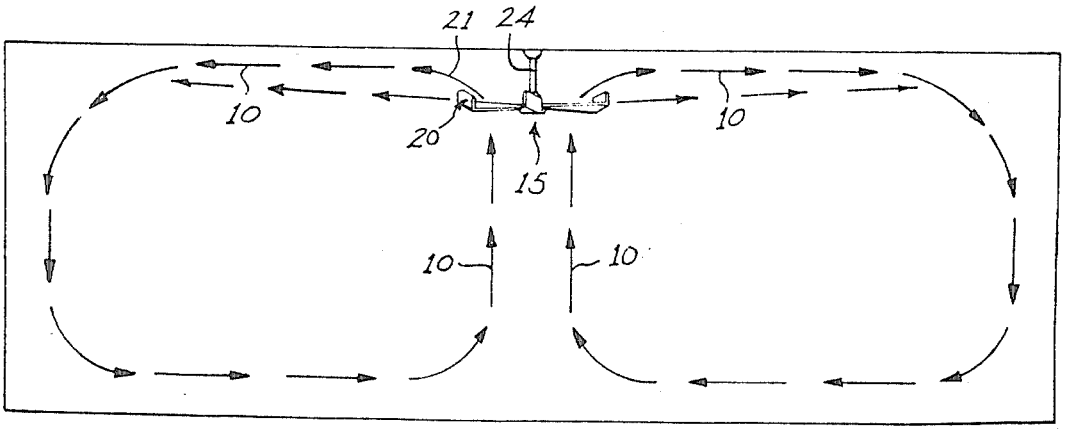
Fig. 3

CEILING FAN

SUMMARY OF THE INVENTION

This application is a continuation-in-part of my copending application, Ser. No. 406,123, filed Aug. 9, 1982 now abandoned.

This invention relates to an improved ceiling fan.

With the conventional ceiling fans, circulation of the air takes a path in which the air is drawn upwardly or downwardly in a column in the axial direction with the blades of the fan substantially perpendicular to the axis of rotation. Lateral dispersal of the air takes place when the air strikes the ceiling if flow is upward, and when it strikes the floor of the room if flow is downward. In this manner the ceiling or floor impact of air flow controls and limits the lateral range of air flow in a room. In a large room this pattern of air flow may not produce a desirable amount of circulation of air throughout the room due to slowing of the air flow as it strikes the ceiling or floor and the lack of an effective provision for directing the air in a desired lateral flow pattern. Also, violent currents of air flow may be created in the vicinity of the fan, which may be uncomfortable to occupants of the room.

This invention provides a simple inexpensive ceiling fan which can actively redistribute the fan generated air flow in a more desirable manner and cause diffusion of generated air currents over a wide lateral area to provide circulation in an area larger than do conventional fans. The blades of the fan may be of the conventional type mounted on a hub for axial rotation and include angular vane portions which include a part or parts extending from each blade at an angle to the surface of the blade which, upon rotation of the fan blades produces always a favorable pressure gradient, and directs air flow radially in a desirable lateral dispersion to provide wide diffusion of the air leaving the fan blades. The salient feature of the design arrangement is such that there can be vanes above the blades only, which are always forwardly inclined; there can be vanes below the blades which are always backwardly inclined; and there can be a combination of forwardly inclined vanes above and backwardly inclined vanes below the blades. Among the three different types of vane arrangement, the common feature is the creation of a favorable pressure gradient from the radial air flow that promotes the axial flow either up or down. In other words, these vane arrangements provide a mechanism to distribute the combined axial and lateral air flow in a more desirable way than do conventional fans. For example, upon fan rotation to produce downward air flow, the forwardly inclined vanes above the blades will scoop air in and draw air flow radially toward the axis of the fan. With the accumulation of air above the blades, a high pressure zone is created above the blades. The high pressure above the blades and the low pressure below the blades in fan operation in a direction to produce downward air flow establishes a favorable pressure gradient, which will increase air flow in the axial direction and thus increase downward air flow. Consequently, the radial flow through the action of the vanes promotes the downward axial flow created by fan operation. On the other hand, the provision of backwardly inclined vanes below the blades will throw air outwardly upon fan rotation in a direction to produce downward air flow. Thus, a low pressure zone is formed below the blades, which will draw air flow downwardly from a favorable pressure gradient to promote axial downward air flow. The third case, which entails the provision of the forwardly inclined vanes above the blades and the backwardly inclined vanes below the blades produces a dynamical action which is a combination of the two cases mentioned above wherein the above-described actions complement each other with the same favorable pressure gradient. In short, the three types of specially arranged additional vanes will create a strong radial air flow. This lateral air flow will, in turn, establish a much larger air circulation dispersed through a much larger area in a room than occurs with conventional fan operation.

Dynamically the vane-generated radial flow also promotes the blade-generated axial flow through the favorable pressure gradient. In addition, the vectorial addition of the axial and radial flow redistributes the air flow under the ceiling fan, making the air distribution more widespread and more comfortable to room occupants. The additional vanes can also be considered as a means to modify and change the air flow distribution to be somewhat similar to that from an oscillating desk fan.

Upon fan rotation to produce upward air flow, the above-mentioned features will still remain with, of course, the air flow direction changed.

An object of this invention is to provide a fan which draws air upwardly or downwardly in a room and diffuses the air radially outwardly from the fan to create a larger air circulation.

Another object is to provide a fan which causes air flow to be diffused in a desirable manner for wider distribution of the air within a room and with less blast effect than produced by prior fans.

Another object is to provide a fan with blades having vanes which produce a flow of air radially outwardly from or inwardly of the fan, depending upon the direction of blade rotation, to supplement and alter the axial air flow created by the blades per se.

Another object is to provide a fan which diffuses air over a wide lateral area and at a comfortable intensity to an occupant of a room and which requires less power for operation.

Another object is to provide a fan with blades and vanes which produce desired air flow and which reduce the number of fans required to cool a given area as a result of the wider lateral diffusion of air flow produced by the fan blades.

Other objects of this invention will become apparent upon a reading of the following description.

BRIEF DESCRIPTION OF THE DRAWINGS

FIG. 1 is a perspective view of one embodiment of the ceiling fan of this invention.

FIG. 2 is a diagram illustrating the pattern of air flow created by fans embodying the prior art.

FIG. 3 is a diagram illustrating the pattern of air flow created by the ceiling fan of this invention.

DESCRIPTION OF THE PREFERRED EMBODIMENT

Figure 4:
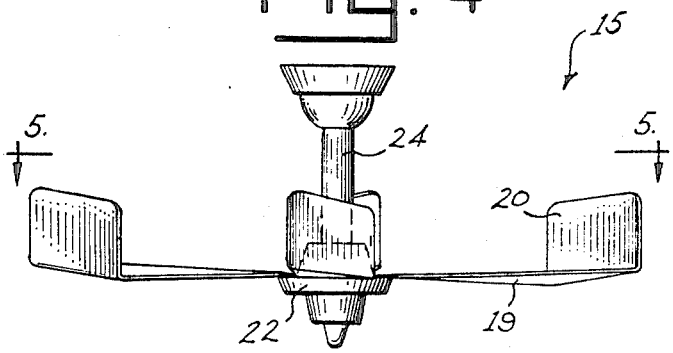
FIG. 4 is a side view of the fan shown in FIG. 1.

The preferred embodiments illustrated are not intended to be exhaustive or to limit the invention to the precise forms disclosed. They are chosen and described in order to explain the principles of the invention and its application and practical use and to enable others skilled in the art to utilize the invention.

The air flow produced by the conventional ceiling fans of the axial type in upward direction is illustrated in FIG. 2 by arrows 12. The operation of the fan 14 draws air upwardly in a column having an axis which coincides with the axis of rotation of the fan blades 16 and leaves the fan blades in a substantially similar axial flow pattern. When the column of air from the conventional fan strikes the ceiling 18, it is deflected downwardly and around the fan into the space below the fan. The amount of lateral air flow is determined by the ceiling impact of the column of air and the velocity of the following air flow.

The upward air flow produced by the embodiments of the ceiling fan of this invention is illustrated in FIG. 3 by arrows 10.

The ceiling fan of this invention does not rely on ceiling impact for the production of lateral air flow. The fan blades 19 carry angularly upwardly projecting vanes 20. Upon rotation of fan blades 19 to produce upward axial air flow, vanes 20 produce radial air flow which moves laterally and outwardly from the upper surfaces of the blades as shown by arrows 10. The air discharged upwardly from the fan blades is drawn outwardly at 21 to react and merge with the air being discharged from the vanes 20 so as to produce a resulting lateral flow of air as shown in FIG. 3. Upon rotation to produce downward air flow, the vanes 20 draw air laterally inwardly to supplement downward air flow from the blades.

Figure 5:
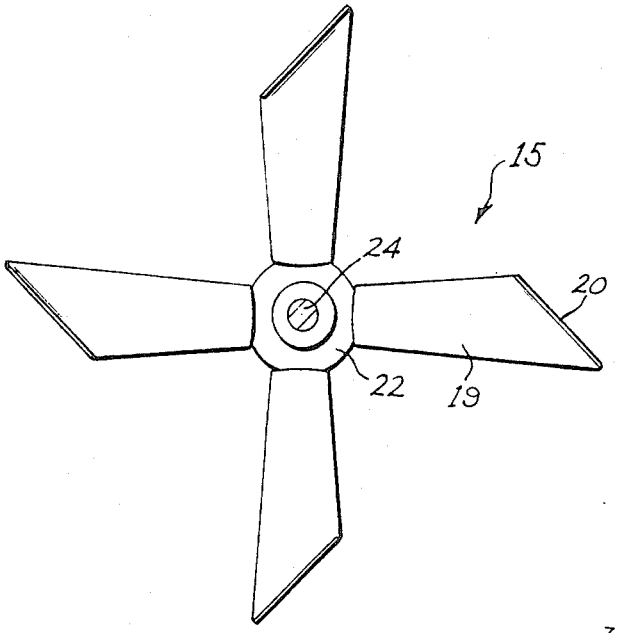
FIG. 5 is a top view of the fan shown in FIG. 4, as seen in the direction of arrow 5—5.

FIGS. 1, 4 and 5 illustrate a first embodiment of the ceiling fan 15 of this invention which includes blades 19 attached to a central hub 22 for rotation about the axis 24. Vanes 20 are shown as upturned end portions of blades 19. As shown, vanes 20 are generally perpendicular to the surface of blades 19 and have a pitch or angle relative to the radius of rotation of the blades to produce centrifugal or centripetal air flow depending on the direction of blade rotation, hereinafter referred to as a "back pitch."

Figure 6:
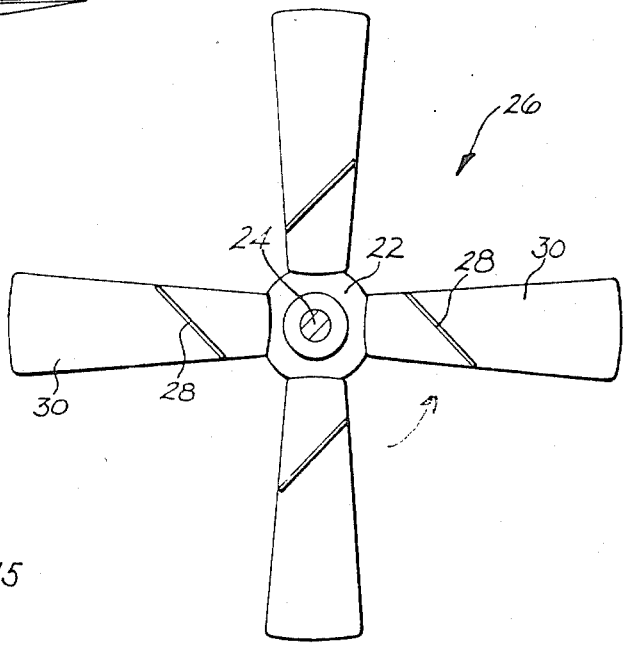
FIG. 6 is a top view of a second embodiment of this invention.

A second embodiment of the invention is illustrated by the ceiling fan 26 shown in FIG. 6. Vanes 28 are positioned at selected positions of the length of each blade 30, as between the full line and dotted line positions shown in FIG. 6, and are generally perpendicular to the surface of the blades. Blades 30 are also mounted on a hub 22 for rotation about an axis 24. Vanes 28 have a back pitch relative to the radius of rotation of blades 30.

Figure 7:
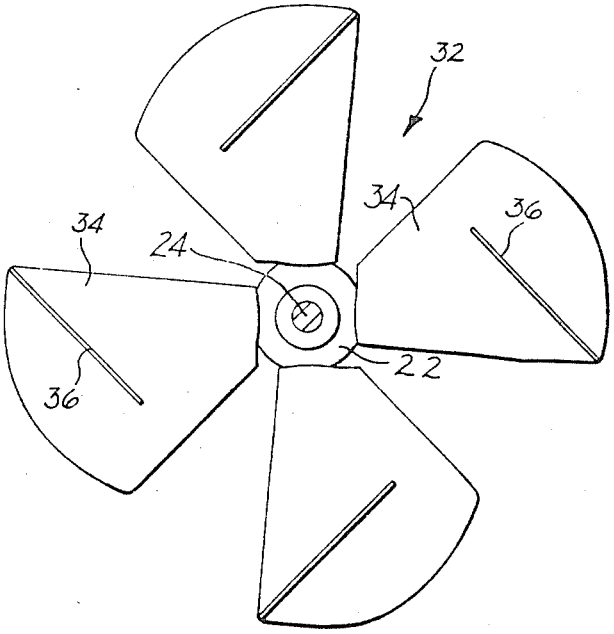
FIG. 7 is a top view of a third embodiment of this invention.

A third embodiment of the invention is illustrated by the ceiling fan 32 shown in FIG. 7. Ceiling fan 32 includes blades 34 mounted on hub 22 for rotation about axis 24. Vanes 36 are mounted on and project from the upper surface of blades 34. Each vane 36 is positioned transversely to the radius of rotation of a blade 34 to give the vane a back pitch relative to the radius of rotation of the blade.

Figure 8:
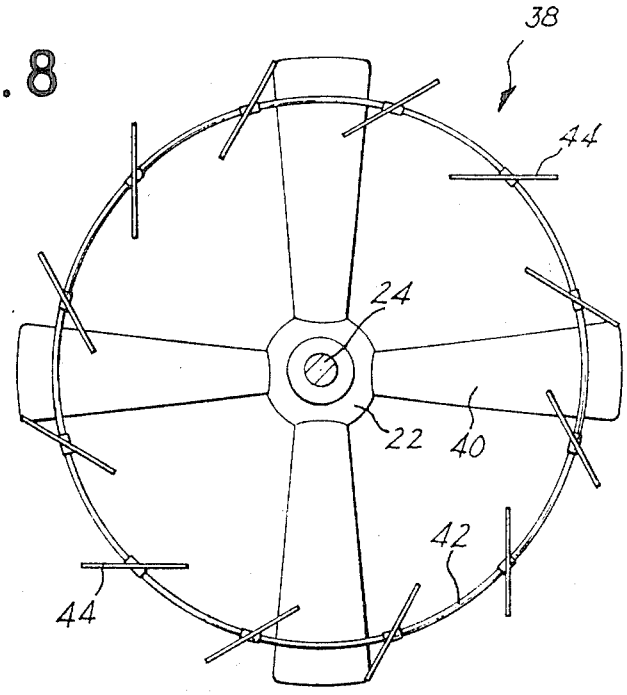
FIG. 8 is a top view of a fourth embodiment of this invention.
Figure 9:
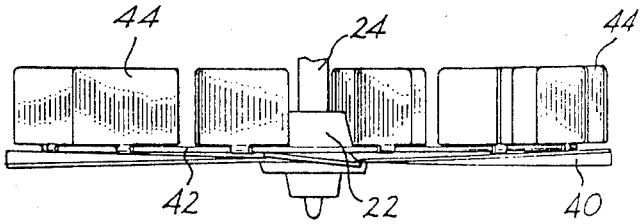
FIG. 9 is a side view of the fan shown in FIG. 8.

A fourth embodiment of this invention is illustrated by the ceiling fan 38 shown in FIGS. 8 and 9. Fan 38 includes blades 40 connected to hub 22 for rotation about axis 24. An endless rigid member, such as a ring 42, is connected to the upper surfaces of blades 40 and has an axis of rotation coinciding with axis 24. Substantially equi-spaced vanes 44 are connected to member 42 in a generally perpendicular relationship to the upper surfaces of blades 40. Vanes 44 are positioned transversely relative to the radius of rotation of blades 40 and have a back pitch relative to the radius of rotation of the blades.

Figure 10:
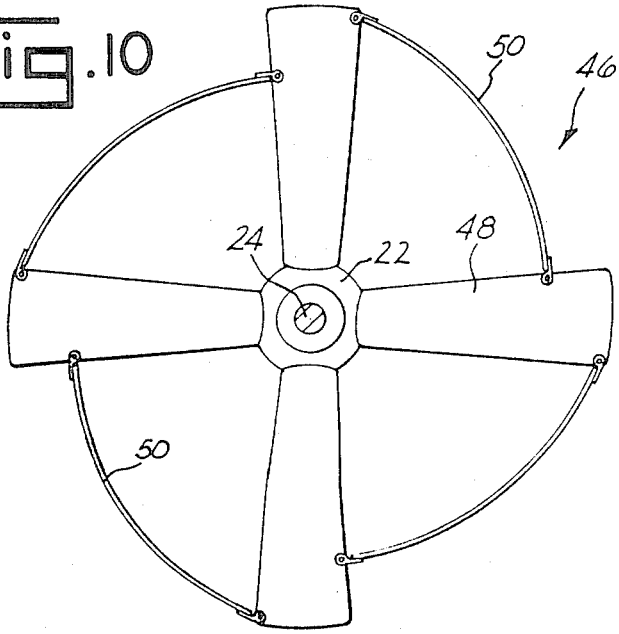
FIG. 10 is a top view of a fifth embodiment of this invention.
Figure 11:
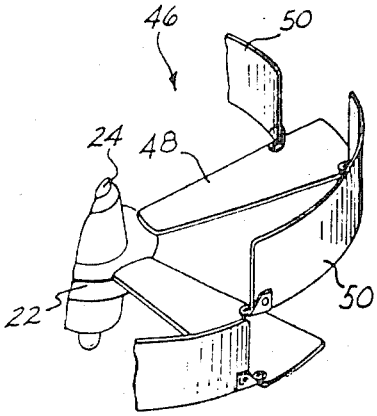
FIG. 11 is a fragmentary perspective view of the embodiment shown in FIG. 10.
Figure 12:
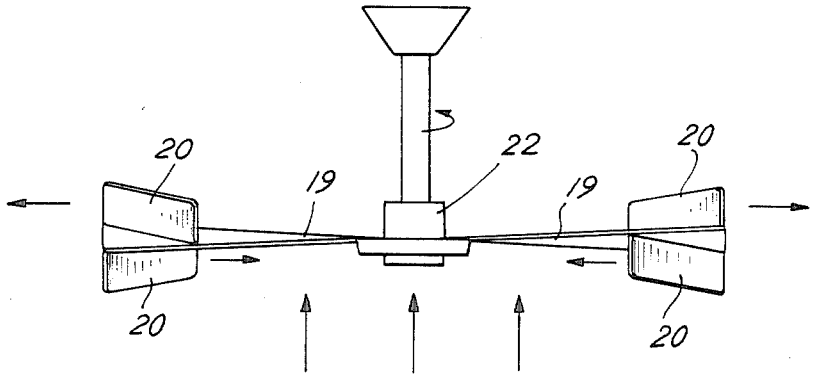
FIG. 12 is a view illustrating a fan with vanes located above and below the blades and of opposite pitch.

A fifth embodiment of the invention is illustrated by the ceiling fan 46 shown in FIGS. 10 and 11. Ceiling fan 46 includes blades 48 which are connected to a hub 22 to rotate about an axis 24. Vanes 50 are generally perpendicular to the upper surface of blades 48 and are connected at their ends to adjacent blades. One end of each vane 50 is connected to one blade 48 intermediate the length of the blade and at its other end to the adjacent blade 48 at a different distance from hub 22 than said first named end. This construction gives vanes 50 a back pitch relative to the radius of rotation of blades 48.

The vanes may alternatively be mounted to project above the blades or downwardly from the blades or to project both upwardly and downwardly from the blades. When both upwardly and downwardly projecting vanes are mounted on the same blade, the angular positioning of the vanes relative to the blade can be forwardly inclined for the upper vanes and backwardly inclined for the lower vanes. In all cases, the positioning of the vanes relative to the length of the blades must be such that fan rotation is substantially free of vibration, even if radial spacing of vanes on some blades differs from spacing of vanes on other blades or from spacing of vanes at the opposite side of the same blade.

Tests of this fan construction reveal that, with the proper size and angle of the vanes, it is possible to increase the efficiency of a fan which is otherwise similar but lacks the vanes. The efficiency increase has been determined either by a reduction in the amount of power or energy required to rotate the fan or by an increase in the rate of flow (cfm) produced by the fan with the exercise of the same amount of energy. This increased efficiency has been found by tests to occur regardless of the direction of rotation of the blades and regardless of whether the vanes extend upwardly or downwardly from the blades.

In all embodiments of the invention, the fan blades may be of any selected pitch and may be of either constant pitch throughout their length or of varying pitch throughout their length. Varying pitch blades may be the type having maximum pitch near the hub so as to substantially equalize the air flow rate along the length of each blade. Also, the invention is not intended to be otherwise limited by the terms of the above description but may be modified within the scope of the appended claims.

I claim:

1. In combination, a ceiling fan having a plurality of radially extending blades mounted to rotate about a vertical axis, and means for rotating said fan in selected direction, said blades being shaped and positioned to discharge air upwardly from said blades when rotated in one direction and to discharge air downwardly from said blades upon rotation thereof in the opposite direction, and a vane portion projecting angularly in selected fixed relation from a face of each blade, said vane portions being spaced from the axis of rotation of the blades and positioned on said blades to provide rotative balance of the fan as it rotates, said vanes being positioned to extend similarly substantially diagonally of said blades and being shaped to generate substantially radial air flow in direction and magnitude to intercept and commingle with axial air flow generated by rotation of said blades and thereby produce a favorable pressure gradient across the blades and create air flow with moderate distribution intensity throughout a greater area than the air flow produced by a similar fan which does not have said vanes, said blades include both forwardly inclined vanes above the blades and backwardly inclined vanes below the blades when said blades are rotated in one direction.

2. The ceiling fan of claim 1 wherein said vane portions include strips oriented generally perpendicularly to said blade surfaces, each strip being connected at its ends to adjacent blades at different distances from said axis to provide a back pitch when said blades are rotated in one direction.

* * * * *